US005875884A

United States Patent [19]

Tomotoshi

[11] Patent Number: 5,875,884

[45] Date of Patent: Mar. 2, 1999

[54] SLIDE SWITCH APPARATUS

[75] Inventor: Tetsuya Tomotoshi, Tokyo, Japan

[73] Assignee: Niles Parts Co., Ltd., Japan

[21] Appl. No.: 956,421

[22] Filed: Oct. 23, 1997

[30] Foreign Application Priority Data

Oct. 30, 1996 [JP] Japan ..... 8-304063

[51] Int. Cl.[6] ..... H01H 1/36; H01H 15/00

[52] U.S. Cl. ..... 200/252; 200/16 R; 200/61.88

[58] Field of Search ..... 200/16 R–16 D, 200/537, 547, 550, 252, 257, 260, 61.85, 61.88, 61.28

[56] References Cited

U.S. PATENT DOCUMENTS

| | | | |
|---|---|---|---|
| 4,137,440 | 1/1979 | Bryant | 200/159 R |
| 4,152,565 | 5/1979 | Rose | 200/291 |
| 4,324,958 | 4/1982 | Valleau | 200/16 F |
| 4,369,424 | 1/1983 | Miyamoto | 338/161 |
| 4,857,678 | 8/1989 | Lipp | 200/16 R |
| 5,231,254 | 7/1993 | Baker et al. | 200/61.91 |

FOREIGN PATENT DOCUMENTS

| | | | |
|---|---|---|---|
| SHO57-117523 | 7/1982 | Japan | H01H 23/12 |

*Primary Examiner*—Michael A. Friedhofer
*Attorney, Agent, or Firm*—Ronald P. Kananen; Rader, Fishman, & Grauer

[57] ABSTRACT

A slide switch apparatus having a movable contact and a movable board arranged to prevent chattering between the movable contact and the movable board, even when the slide switch apparatus is immersed in a high temperature oil. The movable contact can be assembled onto the movable board in a one-touch manner. The movable board (3) has a gap (37), a step portion (32, 33), and an engaging portion (34, 35). The gap extends in a direction perpendicular to a direction of sliding of the movable board (3) so that the movable contact (2) can be inserted thereinto in that perpendicular direction. The step portion (34, 35) has a valley shape in sectional view. The movable contact (2) has a leadframe (26) inserted in the gap (37) of the movable board (3), and a chatter preventive piece (22, 23, 24, 25) engaged with the step portion (32, 33) and the engaging portion (34, 35).

9 Claims, 4 Drawing Sheets

SLIDE SWITCH APPARATUS

BACKGROUND OF THE INVENTION

1. Field of the Invention

The present invention relates generally to an improved slide switch apparatus having a movable contact held by a movable board arranged to be slidably contacted with a fixed contact so as to perform switch operation. More particularly, the present invention relates to an improved slide switch apparatus for accurately detecting a shift position of an automatic transmission of an automobile to prevent chatter from occurring between the movable contact and the movable board due to thermal expansion or change in tolerance, even when the switch is immersed in a high-temperature oil for use as an in-oil inhibitance switch installed in an automatic transmission, the switch being assembled onto a movable board in a one-touch manner.

2. Description of the Related Art

A conventional slide switch apparatus is shown, for example, in FIG. 7. This conventional slide switch comprises a movable board (a) having an engaging portion (d), and having in a movable contact attaching surface a support projection (c) for supporting a movable contact (b). An elastic rib (f) having an engaging projection (e) is provided for engaging the movable contact (b) opposite to the engaging portion (d).

Another conventional slide switch is shown, for example, in FIG. 8. This conventional slide switch comprises a movable board (g) having a projection (h) that is cold-crimped, and a movable contact (i) fixed to the movable board (g) through screw fastening or ultrasonic welding. The slide switch apparatuses shown in FIGS. 7 and 8 are disclosed in Japanese Unexamined Utility Model Publication No. S57-117523.

In the above-described conventional slide switch structure shown in FIG. 7, however, there has been a problem that chattering occurs due to occurrence of a gap (G) between the movable board (a) and the movable contact (b), as shown in FIG. 7. The gap (G) results from changes in tolerance introduced during forming the movable board (g) and the movable contact (b) or from thermal expansion caused when the apparatus is installed within an automatic transmission of an automobile to be used by immersion in a high-temperature oil.

Furthermore, it is impossible in the conventional slide switch structure shown in FIG. 8 to assemble the movable contact (i) onto the movable board (g) in a one-touch manner. Moreover, there has been a problem that chattering occurs in the movable contact (i) due to loosening of crimping in the projection (h) during service in an immersed state in a high-temperature oil over a long period of time.

SUMMARY OF THE INVENTION

An object of the present invention is to provide a slide switch apparatus that solves the problems with the conventional slide switch apparatuses described above.

More specifically, an object of the present invention is to prevent chatter from occurring in a slide switch between a movable contact and a movable board, with the movable contact assembled onto the movable board in a one-touch manner, even when the slide switch apparatus is used in a state of being immersed in a high-temperature oil.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a slide switch apparatus is provided comprising: a movable contact, a movable board for supporting the movable contact, a fixed contact with which the movable contact is slidably contacted, and a printed board for supporting the fixed contact; wherein the movable board comprises: a gap in which the movable contact can be inserted in a direction perpendicular relative to a direction of sliding thereof, a step portion formed on an extension line of the gap, and an engaging portion having a valley shape in sectional view; and the movable contact comprises: a lead frame inserted in the gap, and a chatter preventive piece provided in the lead frame correspondingly to the step portion and the engaging portion so as to be engaged with the step portion and the engaging portion.

The movable board of the slide switch apparatus according to the present invention has the step portion and the engaging portion at opposite ends thereof.

The chatter preventive piece is elastically fitted with the step portion of the movable board so as to prevent the movable contact from chattering in a rectangular direction.

The chatter preventive piece is press-contacted with the engaging portion of the movable board so as to prevent the movable contact from chattering in a slide direction thereof.

The movable board is coupled to a manual valve within an automatic transmission of an automotive vehicle.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
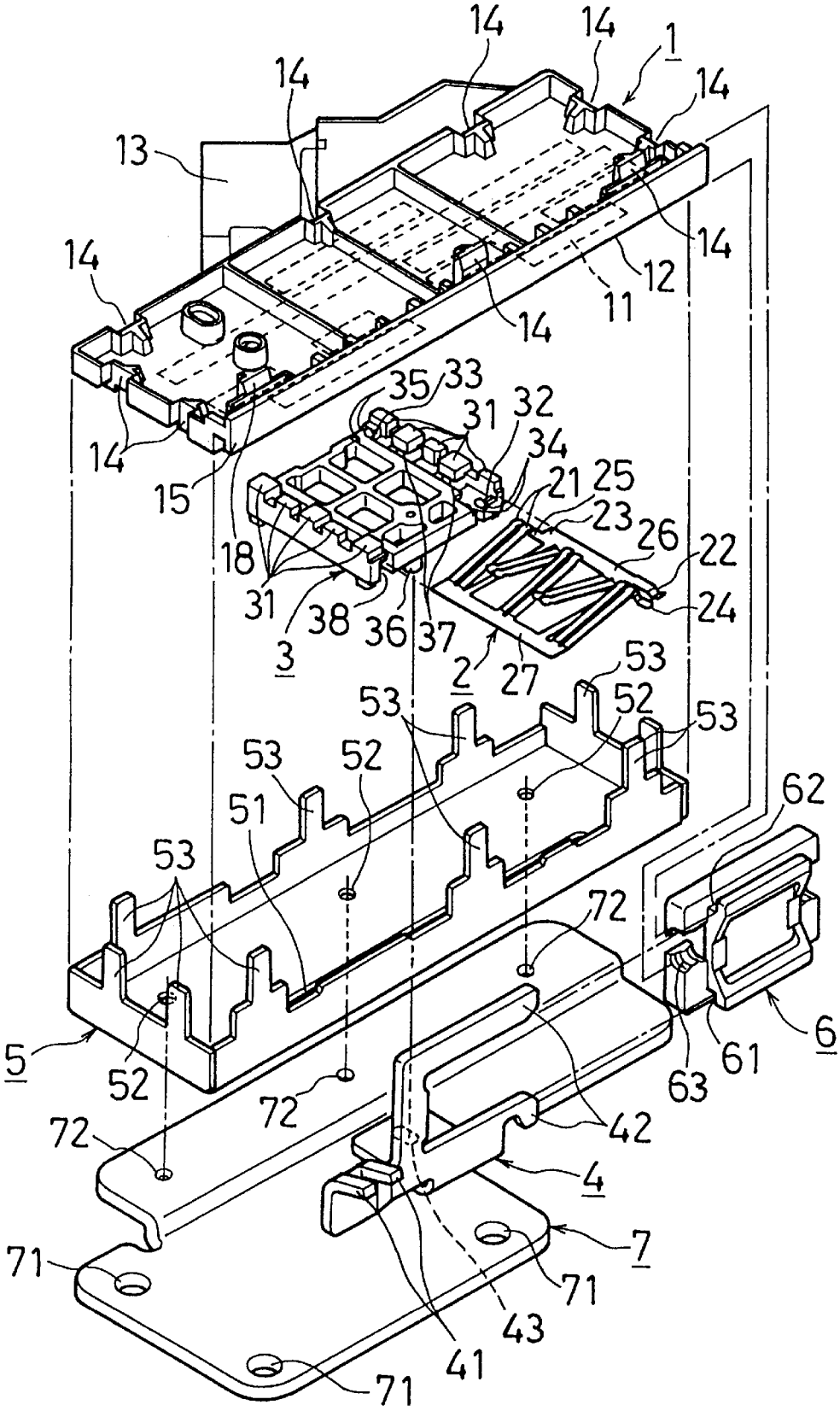
FIG. 1 is an exploded perspective view showing a slide switch apparatus according to a preferred embodiment of the present invention.
Figure 2:
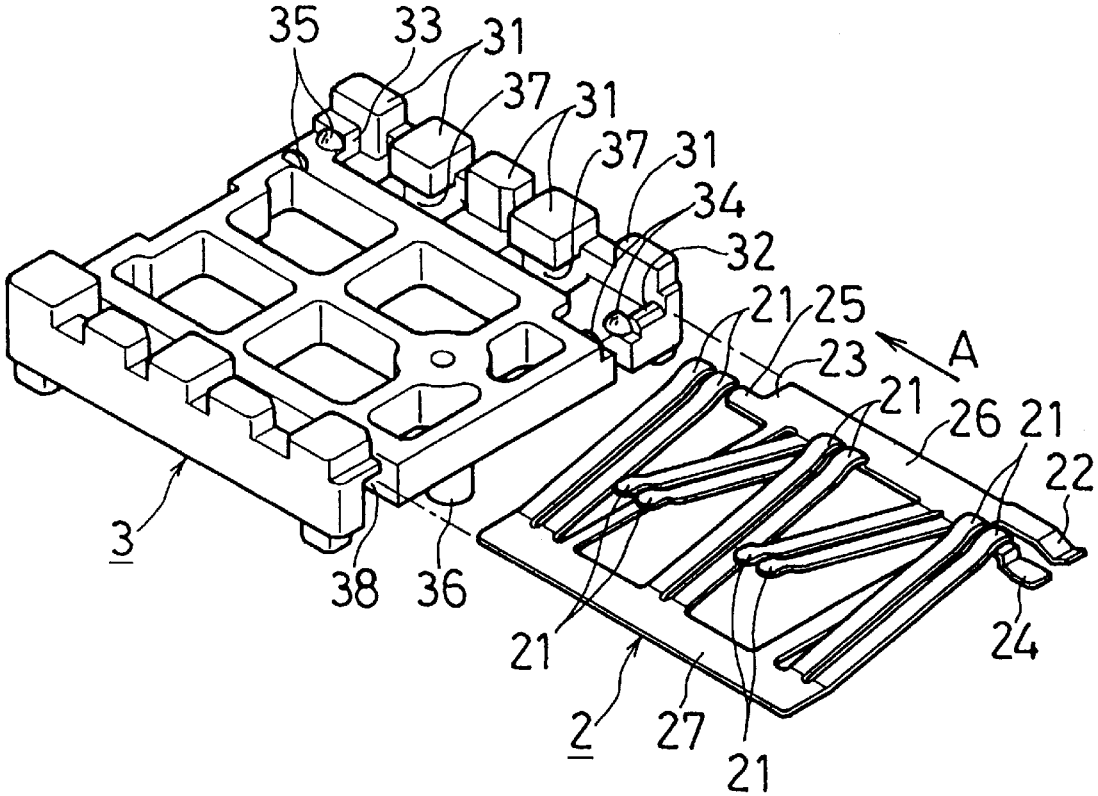
FIG. 2 is a perspective view showing the detail of a movable contact and a movable board shown in FIG. 1.
Figure 3:
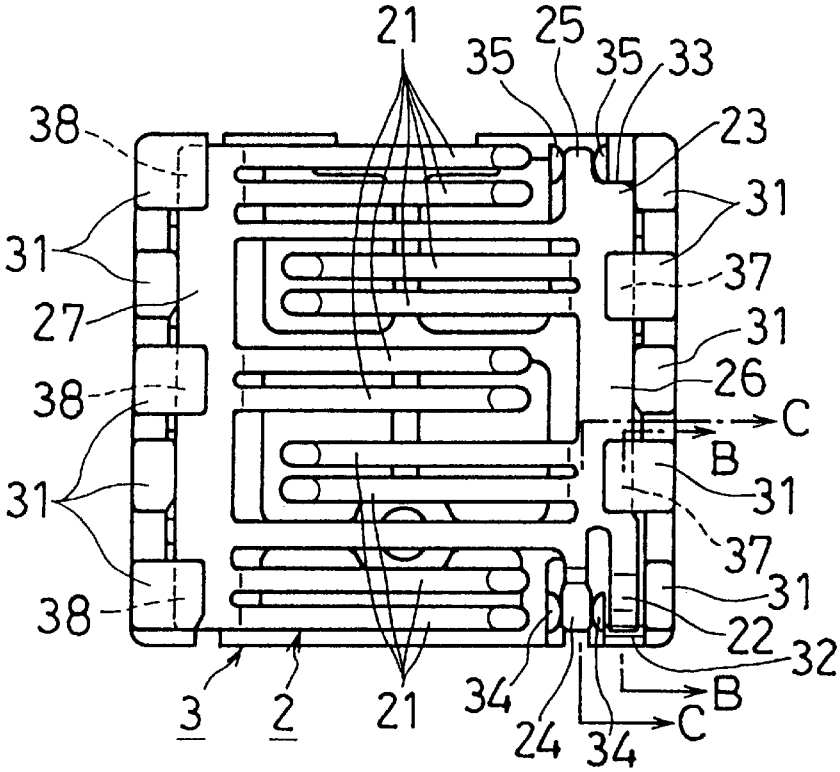
FIG. 3 is a plan view showing a state that the movable contact shown in FIG. 1 is mounted on the movable board.
Figure 4:
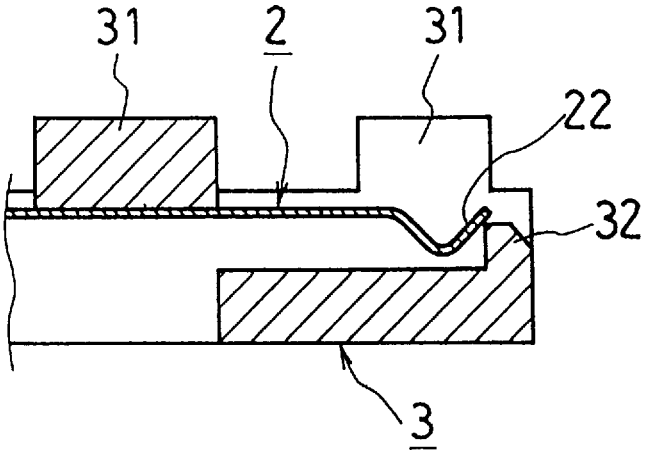
FIG. 4 is a sectional view of the movable contact and movable board taken on line B—B in FIG. 3.
Figure 5:
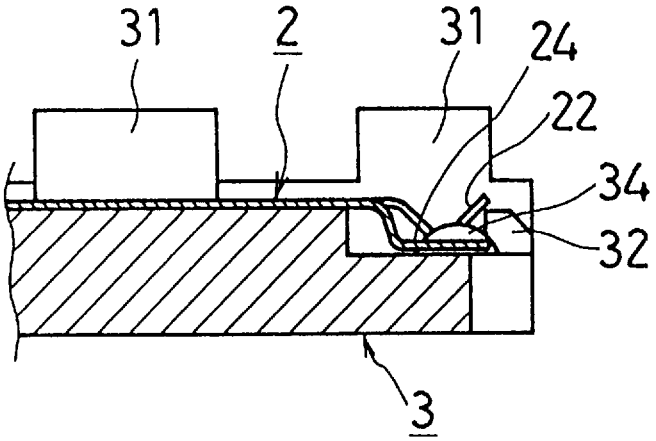
FIG. 5 is a sectional view of the movable contact and movable board taken on line C—C in FIG. 3.

A preferred embodiment of a slide switch apparatus according to the present invention will now be described in detail with reference to FIGS. 1 to 6 of the accompanying drawings.

The slide switch apparatus comprises a printed board 1 formed of a synthetic resin having resistance to heat and oil to withstand being immersed in a high-temperature oil contained within an automatic transmission. The printed board 1 has five rows of fixed contacts 11 at a back surface 12 thereof. The fixed contacts 11 are portions over which a movable contact 2 slides in contact therewith. A plurality of walls (not shown) are provided along the fixed contacts 11. These walls have dual functions to enhance insulation resistance between the fixed contacts 11 and to guide therealong a projection 31 of the movable contact 3.

The printed board 1 has a connector 13 integrally formed therewith so that terminals (not shown) electrically connected to the fixed contacts 11 are projected to an inside of the connector 13. Further, the printed board 1 has several crimp portions 14 provided at locations in a periphery thereof. The crimp portions 14 are portions on which respective crimp pieces 53 are to be crimped over.

The movable contact 2 is a part that slides in contact over the fixed contact 11. The movable contact 2 has contact pieces 21 in a number corresponding to the number of rows, i.e., five sets, of the fixed contacts alternately arranged. Each set of the contact pieces 21 is comprised by a pair. Also, the movable contact 2 has chatter-preventive pieces 22, 23, 24, 25 and leadframes 26, 27.

The leadframes 26, 27 are inserted in gaps 37 and are formed by press-working a springy stainless steel sheet or the like into one body having the contact pieces 21. The chatter preventive pieces 22, 23, 24, 25 are provided in the leadframe 26 at locations corresponding to the step portions 32, 33 and the engaging portions 34, 35 of the movable board 3. By engaging the chatter preventive pieces 22, 23, 24, 25 with the step portions 32, 33 and the engaging portions 34, 35, the movable contact 2 can be assembled on the movable board in a one-touch manner.

The movable board 3 is formed of a synthetic resin to have projections 31 for wiping over the surface of the fixed contact 11, gaps 37 extending in a direction perpendicular to a direction of sliding so as to receive therein the movable contact 2 in that perpendicular direction, step portions 32, 33 formed on an extension line of the gaps 37, and engaging portions 34, 35 formed sectionally in a valley-like form. Further, a metallic pin 36 engageable with an operating portion 4 is insert-formed in the movable board 3.

A procedure for assembling the movable contact 2 onto the movable board 3 in a one-touch manner will now be explained. First, the leadframes 26, 27 of the movable contact 2 are inserted into the respective gaps 37, 38 of the movable board 3 in a direction of the arrow A shown in FIG. 2. When the movable contact 2 is inserted by a certain amount, the second chatter preventive piece 23 is brought into abutment against the second step portion 33. As a result, the movable contact 2 cannot be inserted further.

At this time, the first chatter preventive piece 22 provided on the opposite side to the second chatter preventing piece 23 gets over the first step portion 32 to be elastically fitted with the movable board 3. In this manner, the movable contact 2 is prevented from chattering in a rectangular direction.

On the other hand, the third and fourth chatter preventive pieces 24, 25 are respectively press-contacted with the first and second engaging portions 34, 35. To this end, the movable contact 2 is prevented from chattering in a slide direction.

The operating portion 4 has a coupling portion 41 for being coupled to a manual valve (not shown) of an automatic transmission, an insertion portion 42 for being fitted over by a guide block 6, and an engaging hole 43 for being engaged with a pin 36 of the movable board 3. The engaging hole 43 is formed in an elongate hole that is long in a direction perpendicular to the direction of movement of the movable board 3.

A frame member 5 is a part that is press-worked from a metallic plate. The frame member 5 is provided with an elongate hole 51 into which a pin 36 of the movable board 3 is inserted, a hole 52 provided corresponding to a hole 72 of a bracket 7, and crimp pieces 53 for being crimped over respective crimp portions 14 of the printed board 1. The movable board 3 is accommodated in a space defined by the frame member 5 and the printed board 1. Incidentally, the width of the elongate hole 51 is set somewhat greater than the diameter of the pin 36.

The guide block 6 is a part interposed between the operating portion 4 and the printed board 1 so that the operating portion 4 is guided along a rail 15 provided in the printed board 1. The guide block 6 is provided with grooves 61, 62 into which respective insertion portions 42 of the operating portion 4 are inserted, and a recessed portion 63 into which the rail 15 of the printed board 1 is inserted.

The bracket 7 has holes 71 for attachment to a case of the automatic transmission, and holes 72 for attachment to the frame member 5. The bracket 7 and the frame member 5 are fixed by tightening nuts (not shown) through the holes 72 and the holes 52.

The operation of the above-described embodiment will now be explained. The slide switch apparatus of this embodiment is installed within the case of the automatic transmission in a position with an upward direction taken as the UP arrow shown in FIG. 6. The coupling portions 41 of the operating portion 4 are coupled with a manual valve and a detent lever (both not shown). Consequently, if a driver operates a shift lever (not shown) to actuate the detent lever, the manual valve and the operating portion 4 are moved to their corresponding shift positions. On this occasion, the movable board 3 coupled to the operating portion 4 through the pin 36 is moved together with the operating member 4 so that the contact position of the movable contact 2 of the movable board 3 relative to the fixed contact 11 is switched over. This enables the slide switch apparatus to operate a switching function corresponding to a shift position of the automatic transmission.

Figure 6:
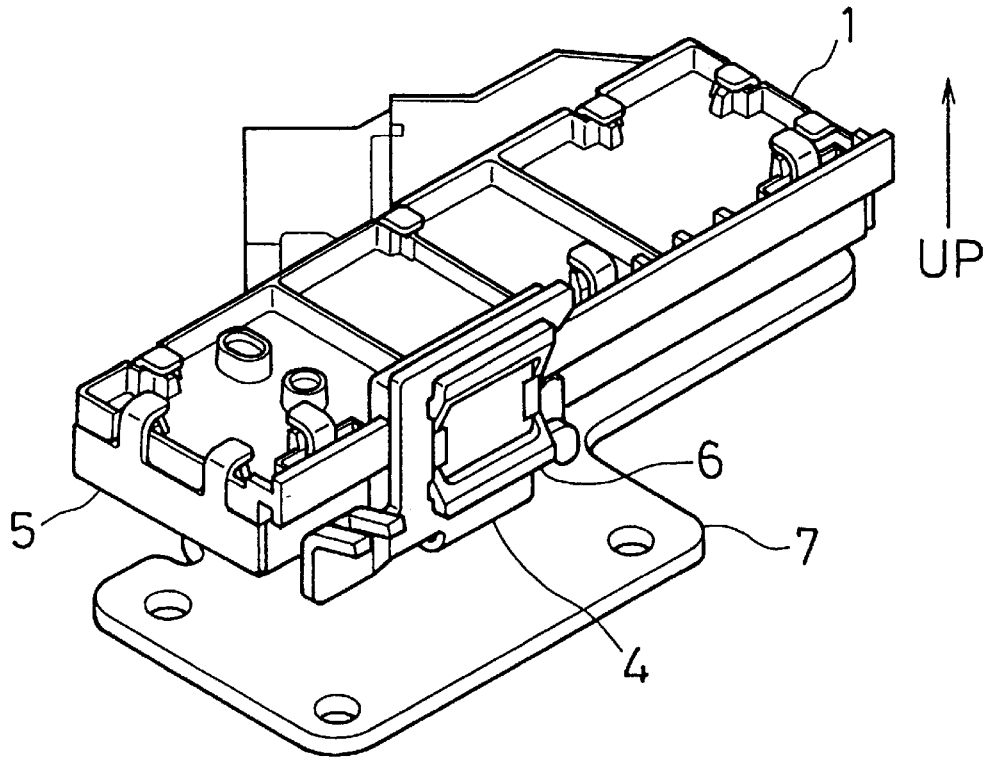
FIG. 6 is a perspective view of the slide switch apparatus shown in FIG. 1 in an assembled state.
Figure 7:
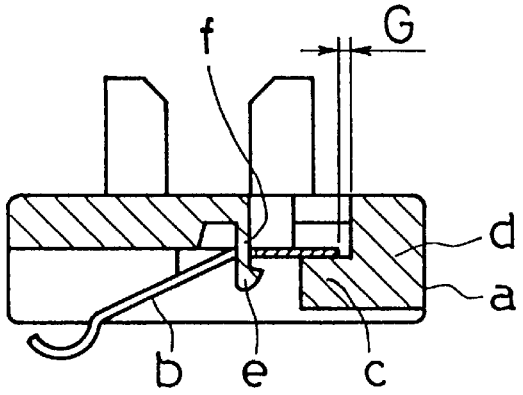
FIG. 7 PRIOR ART
FIG. 7 is a sectional view showing a conventional slide switch apparatus.
Figure 8:
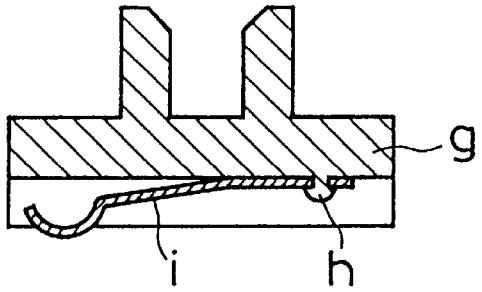
FIG. 8 PRIOR ART
FIG. 8 is a sectional view showing another conventional slide switch apparatus.

In this case, since the slide switch apparatus is installed in the position with the upward direction taken as the UP arrow shown in FIG. 6, as stated before, within the automatic transmission case, the fixed contacts 11 of the printed board 1 are directed downward. As a consequence, foreign matter adhered to the fixed contacts 11 falls due to the force of gravity, to be stripped off from the fixed contacts 11. To this end, the slide switch apparatus does not undergo poor insulation caused between the fixed contacts 11, even where it is used by immersion in an oil contaminated by being mixed with conductive foreign matters within the automatic transmission.

The slide switch apparatus according to the invention provides a slide switch apparatus having a movable contact, a movable board for supporting the movable contact, a fixed contact with which the movable contact is slidably contacted, and a printed board for supporting the fixed contact, wherein the movable contact comprises: a gap in which the movable contact can be inserted in a direction perpendicular relative to a direction of sliding thereof, a step portion formed on an extension line of the gap, and an engaging portion formed with a valley shape in sectional view; and the movable contact comprises: a leadframe inserted in the gap, and a chatter preventive piece provided in the lead frame correspondingly to the step portion and the engaging portion so as to be engaged with the step portion and the engaging portion. Therefore, even where the slide switch apparatus is used in an ordinary manner or in a state of being immersed in a high-temperature oil, chattering can be prevented from occurring between the movable contact and the movable board. Furthermore, the movable contact can be assembled onto the movable board in a one-touch manner.

Also, since the movable board has the step portion and the engaging portion at opposite ends thereof, an effect that the movable board is positively held at opposite ends thereof is provided, in addition to the above effect.

Further, since the chatter preventive piece is elastically fitted with the step portion of the movable board, an effect that the movable contact is prevented from chattering in a rectangular direction is provided, in addition to the above effects.

Besides, since the chatter preventive piece is press-contacted with the engaging portion of the movable board, an effect is provided that the movable contact is prevented from chattering in a slide direction thereof, in addition to the above effects.

In addition, since the movable board is coupled to a manual valve within an automatic transmission of an automotive vehicle, an effect is provided that the shift position of the automatic transmission is detected with high accuracy, in addition to the above effects.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A slide switch apparatus having a movable contact (2), a movable board (3) for supporting said movable contact (2), a fixed contact (11) with which said movable contact (2) is slidably contacted, and a printed board (1) for supporting said fixed contact (11);

wherein said movable board (3) comprises:

a gap (37) in which said movable contact (2) can be inserted in a direction perpendicular relative to a direction of sliding thereof;

a step portion (32, 33) formed on an extension line of said gap (37); and an engaging portion having a valley shape; and wherein said movable contact (2) comprises:

a leadframe (26) inserted in said gap (37); and a chatter preventive piece (22, 23, 24, 25) provided in said lead frame (26) correspondingly to said step portion (32, 33) and said engaging portion (34, 35) so as to be engaged with said step portion (32, 33) and said engaging portion (34, 35).

2. The slide switch apparatus according to claim 1, wherein said movable board (3) has said step portion (32, 33) and said engaging portion (34, 35) at opposite ends thereof.

3. The slide switch apparatus according to claim 2, wherein said chatter preventive piece (22, 23) is elastically fitted with said step portion (32, 33) of said movable board (3) so as to prevent said movable contact (2) from chattering.

4. The slide switch apparatus according to claim 3, wherein said chatter preventive piece (24, 25) is press-contacted with said engaging portion (34, 35) of said movable board (3) so as to prevent said movable contact (2) from chattering in the sliding direction of the movable board.

5. The slide switch apparatus according to claim 4, wherein said movable board (3) is coupled to a manual valve within an automatic transmission of an automotive vehicle.

6. The slide switch apparatus according to claim 1, wherein said chatter preventive piece (22, 23) is elastically fitted with said step portion (32, 33) of said movable board (3) so as to prevent said movable contact (2) from chattering.

7. The slide switch apparatus according to claim 1, wherein said chatter preventive piece (24, 25) is press-contacted with said engaging portion (34, 35) of said movable board (3) so as to prevent said movable contact (2) from chattering in the sliding direction thereof.

8. The slide switch apparatus according to claim 1, wherein said movable board (3) is coupled to a manual valve within an automatic transmission of an automotive vehicle.

9. A slide switch apparatus for detecting a shift position of an automatic transmission of an automobile, comprising:

a movable contact (2) having first and second leadframes (26, 27) formed on opposite sides thereof, said first leadframe (26) having first, second, third, and fourth chatter preventive pieces (22, 23, 24, 25) formed thereon, said first and third chatter preventive pieces (22, 24) being provided at a first end of said leadframe (26), and said second and fourth chatter preventive pieces (23, 25) being provided at a second end of said leadframe (26) opposite to said first end of said leadframe (26);

a movable board (3) for supporting said movable contact (2), said movable board (3) being slidable in a first direction and having a gap (37) into which said movable contact (2) can be inserted in a second direction relative to said movable board (3), said second direction being perpendicular to said first direction;

said movable board (3) comprising a first step portion (32) and a second step portion (33) respectively formed at opposite ends of said gap (37), said first and second chatter preventive pieces (22, 23) being elastically engaged with said first and second step portions (32, 33) of said movable board (3), respectively, so as to prevent said movable contact (2) from chattering in said second direction;

said movable board (3) further comprising first and second engaging portions (34, 35) formed adjacent said first and second step portions (32, 33), respectively, said first and second engaging portions (34, 35) each having a converging valley shape for receiving said third and fourth chatter preventive pieces (24, 25), respectively, said third and fourth chatter preventive pieces (24, 25) being press-contacted elastically with said first and second engaging portions (24, 25), respectively, so as to prevent said movable contact (2) from chattering in said first direction;

a fixed contact (11) with which said movable contact (2) is slidably contacted; and a printed board (1) for supporting said fixed contact (11).

* * * * *